US007785149B2

(12) United States Patent
Kamata et al.

(10) Patent No.: US 7,785,149 B2
(45) Date of Patent: Aug. 31, 2010

(54) CONNECTOR FOR ON-BOARD MOUNTING

(75) Inventors: Kazushi Kamata, Aomori (JP); Koji Kawase, Taichung (TW); Kan Ozawa, Tokyo (JP); Kenichi Kotaka, Tokyo (JP)

(73) Assignees: Japan Aviation Electronics Industry, Limited, Tokyo (JP); Jae Taiwan, Ltd., Taichung (TW)

( * ) Notice: Subject to any disclaimer, the term of this patent is extended or adjusted under 35 U.S.C. 154(b) by 0 days.

(21) Appl. No.: 12/418,013

(22) Filed: Apr. 3, 2009

(65) Prior Publication Data

US 2009/0253297 A1 Oct. 8, 2009

(30) Foreign Application Priority Data

Apr. 4, 2008 (JP) ..... 2008-098699

(51) Int. Cl.
*H01R 13/648* (2006.01)

(52) U.S. Cl. ..... 439/607.35; 439/570

(58) Field of Classification Search ..... 439/607.35, 439/570, 571, 607.37
See application file for complete search history.

(56) References Cited

U.S. PATENT DOCUMENTS 5,178,557 A * 1/1993 Hashiguchi ..... 439/357
6,296,518 B1 * 10/2001 Avery et al. ..... 439/541.5
6,354,875 B1 * 3/2002 Wu ..... 439/607.13
6,468,108 B1 * 10/2002 Wu ..... 439/567
6,932,647 B2 * 8/2005 Murayama ..... 439/607.37
2009/0253297 A1 * 10/2009 Kamata et al. ..... 439/607.35
2010/0035459 A1 * 2/2010 Briant et al. ..... 439/352

FOREIGN PATENT DOCUMENTS

JP 2007-59151 3/2007

* cited by examiner

*Primary Examiner*—James Harvey
(74) *Attorney, Agent, or Firm*—Hovey Williams LLP

(57) ABSTRACT

The connector for on-board mounting includes a housing body having multiple contacts, metal locking engagement members each having a locking portion to be engaged with a locked engagement member provided to a cable-side connector for a purpose of locking a connection between connectors and being fixed to the housing body and a metal outer shell member covering a side wall of a front portion of the housing body and provided with opening portions through which the locking engagement members pass. The opening portion of the outer shell member is provided such that an edge thereof which faces the opening portion and the locking engagement member are brought into contact with each other and the locking engagement members and the outer shell member are provided with board-connecting posts on rear portions to be disposed on a board.

7 Claims, 5 Drawing Sheets

CONNECTOR FOR ON-BOARD MOUNTING

The entire contents of documents cited in this specification are incorporated herein by reference.

BACKGROUND OF THE INVENTION

The present invention relates to a connector for on-board mounting, which is mounted on a board such as a printed circuit board to be incorporated in an apparatus, and is connected to a cable-side connector.

A communication cable with which signals are exchanged between electronic apparatuses is used by electrically connecting to each other a connecting terminal (contact) provided on a cable-side connector of the communication cable and a connecting terminal (contact) provided on a board-side connector (connector for on-board mounting).

Nowadays, countermeasures against electrostatic discharge (ESD) are taken for the board-side connector, and the connector devices having structures of various types are proposed as the countermeasures. ESD represents discharge of static electricity charged in the cable from a metal portion of the cable-side connector to the contact of the board-side connector, or discharge of static electricity, which is charged in an operator and moved from the operator to a metal portion of the board-side connector, to the contact of the board-side connector, when the cable-side connector and the board-side connector are connected to each other. ESD damages circuits on a board, and hence the countermeasures against ESD are taken for the board-side connector provided on the apparatus side.

JP 2007-59151 A discloses a connector device for which the countermeasures against ESD are taken. As illustrated in FIGS. 1(a) and (b) of JP 2007-59151 A, the connector device disclosed therein includes an insulative block body having contacts incorporated therein, latch fittings fixed to the block body and latched to a cable connector, and a shield member which has through-holes to be fit-engaged with the latch fittings and covers the outer surface of the block body. The shield member has folded-back pieces formed by folding back the shield member in at least a part of the through-holes, the shield member being brought into elastic contact with the latch fittings through an intermediation of the folded-back pieces.

As described above, in the connector device disclosed in JP 2007-59151 A, the latch fittings and the shield member can be made conductive with each other through an intermediation of the folded-back pieces serving as conductive members. It is stated in the document that, also in the case where the charged cable-side connector is connected, static electricity therein flows through the latch fittings to the ground through an intermediation of the shield member and, therefore, the static electricity is prevented from being discharged to the contact portions.

SUMMARY OF THE INVENTION

In the connector device disclosed in JP 2007-59151 A, the electrical connection between the shield member and the latch fittings is attained by bringing each folded-back piece into contact with one surface of the relevant latch fitting. When latch claw members are engaged and stopped with the latch fittings for the purpose of connecting the cable-side connector to the board-side connector, the latch fittings are worn out and, therefore, there is a risk that the contact pressure of the folded-back pieces to the latch fittings is reduced so as to make the contact unstable or to generate contact failure. As a result, there arises a problem in that the shield member becomes nonconductive with the latch fittings so that the static electricity charged in the shield member is discharged to the contacts.

In order to solve the above-mentioned problems, the present invention has been made to provide a device structure in which countermeasures against ESD can be stably and reliably taken for a connector for on-board mounting (board-side connector) to be connected to a cable-side connector.

The present invention provides a connector for on-board mounting, which is mounted to a board and is connected to a cable-side connector, comprising: a housing body made of an insulative material having multiple contacts which extend to a front and are incorporated therein, premising that a side on which the connector for on-board mounting is connected to the cable-side connector is the front; metal locking engagement members, each comprising a locking portion to be engaged with a locked engagement member provided to the cable-side connector for a purpose of locking a connection between the connector for on-board mounting and the cable-side connector, extending to the front, and being fixed to the housing body; and a metal outer shell member fixed to the housing body so as to cover a side wall of a front portion of the housing body and provided with opening portions through each of which each of the locking engagement members extending to the front passes, wherein each of the opening portions of the outer shell member is provided such that an edge of the outer shell member which face to each of the opening portions, and each of the locking engagement members are brought into contact with each other; and both each of the locking engagement members, and the outer shell member are provided with board-connecting posts on rear portions thereof to be disposed on the board.

In the inventive connector as above, it is preferable that the outer shell member comprises a front outer shell member which has a cylindrical portion for covering the side wall of the front portion, in which the multiple contacts extend to the front, of the housing body so as to be engaged with the cable-side connector, and a rear outer shell member provided to a rear of the front outer shell member, for covering a side wall of a rear portion of the housing body; and both the front outer shell member and the rear outer shell member are provided with the board-connecting posts.

It is also preferable that the front outer shell member is arranged, while covering the side wall of the housing body, from the front so as to be positioned with respect to the housing body; and the rear outer shell member is engaged with the front outer shell member from a rear of the housing body so that the front outer shell member and the rear outer shell member are fixed to the housing body.

Preferably, one of the front outer shell member and the rear outer shell member is provided with fixed pieces partially protruding toward another of the front outer shell member and the rear outer shell member, the another of the front outer shell member and the rear outer shell member being provided with contact spring pieces at positions corresponding to the fixed pieces, the contact spring pieces pressing the fixed pieces toward the housing body for a purpose of maintaining an electrical connection between the front outer shell member and the rear outer shell member; the rear outer shell member is provided with protruding pieces which partially protrude toward the front outer shell member so as to be sandwiched between the front outer shell member and the housing body in a press-contact manner; and the front outer shell member and the rear outer shell member are provided with a engaging/stopping mechanism in which the protruding pieces are arranged while being sandwiched between the front outer shell member and the housing body for a purpose of fixing the front outer shell member and the rear outer shell member so that a relative position therebetween is prevented from being displaced.

In such a case as above, it is preferable that the front outer shell member and the rear outer shell member have contact surfaces which are overlapped with each other when the front outer shell member and the rear outer shell member are engaged with each other; the engaging/stopping mechanism comprises notched grooves, each being provided in one of the contact surfaces, and protruding portions, each being provided on another of the contact surfaces of so as to protrude outward from the another of the contact surfaces correspondingly to each of the notched grooves; and each of the protruding portions is engaged and stopped to each of the notched grooves so that the rear outer shell member is engaged with respect to the front outer shell member.

In the connector for on-board mounting according to the present invention, the opening of the outer shell member is provided such that the edge of the outer shell member, which defines the opening, and the locking engagement member are brought into contact with each other, and both the locking engagement member and the outer shell member are provided with the board-connecting posts on the rear portions thereof to be disposed on the board. The board-connecting posts can be connected to the ground line on the board. Thus, even when static electricity is transmitted from the charged cable-side connector or operator, the static electricity can be discharged to the ground, thereby preventing ESD. Further, the edge of the outer shell member defining the opening and the locking engagement member are brought into contact with each other. Thus, even when either of the board-connecting post of the outer shell member and the board-connecting post of the locking engagement member becomes nonconductive with the ground, conduction with the ground can be attained through an intermediation of the other board-connecting post. Therefore, countermeasures against ESD can be stably and reliably taken.

In addition, when the outer shell member includes the front outer shell member having a board-connecting post and the rear outer shell member having a board-connecting post, the rear outer shell member is engaged with the front outer shell member from the rear of the housing body so that the front outer shell member and the rear outer shell member are brought into contact with each other. As a result, the front outer shell member can be conductive with the ground through an intermediation of the rear outer shell member. Thus, countermeasures against ESD can be stably and reliably taken. When the front outer shell member and the rear outer shell member are brought into contact and engaged at multiple points with each other for the engagement therebetween, paths for electrical conduction are formed at the multiple points. Therefore, even when conduction is eliminated at one point, countermeasures against ESD can be stably and reliably taken.

DETAILED DESCRIPTION OF THE PREFERRED EMBODIMENT

Figure 1A:
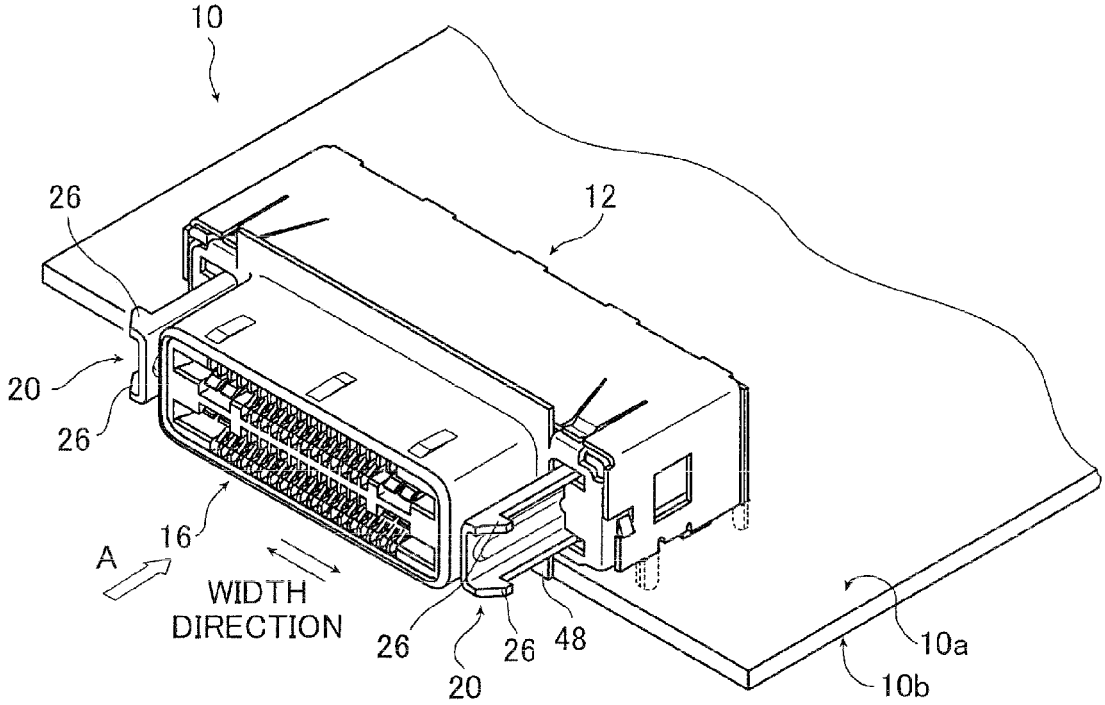
FIG. 1A is a schematic perspective view of the connector for on-board mounting according to the present invention that is mounted on a printed circuit board.

FIG. 1A is a schematic perspective view illustrating a printed circuit board 10 on which a connector for on-board mounting according to the present invention is mounted. On the printed circuit board 10 used as a circuit board of an electronic apparatus such as a computer, to a connector for on-board mounting (hereinafter, referred to as board-side connector) 12 mounted on the printed circuit board 10, a cable-side connector 14 (refer to FIG. 1B) provided at the end of a communication cable is connected in a direction A.

In the following description, the side on which the board-side connector 12 is connected to the cable-side connector 14 is referred to as front, and the opposite side thereto is referred to as rear.

The front portion of the board-side connector 12, which is to be engaged with the cable-side connector 14, protrudes from the edge of the printed circuit board 10 forward, and the rear portion thereof is disposed on the printed circuit board 10. That is, the front direction of the board-side connector 12 is parallel to the plane of the printed circuit board 10. Note that, in the present invention, the board-side connector may be formed such that the front direction of the board-side connector 12 is perpendicular to the plane of the printed circuit board 10.

Figure 1B:
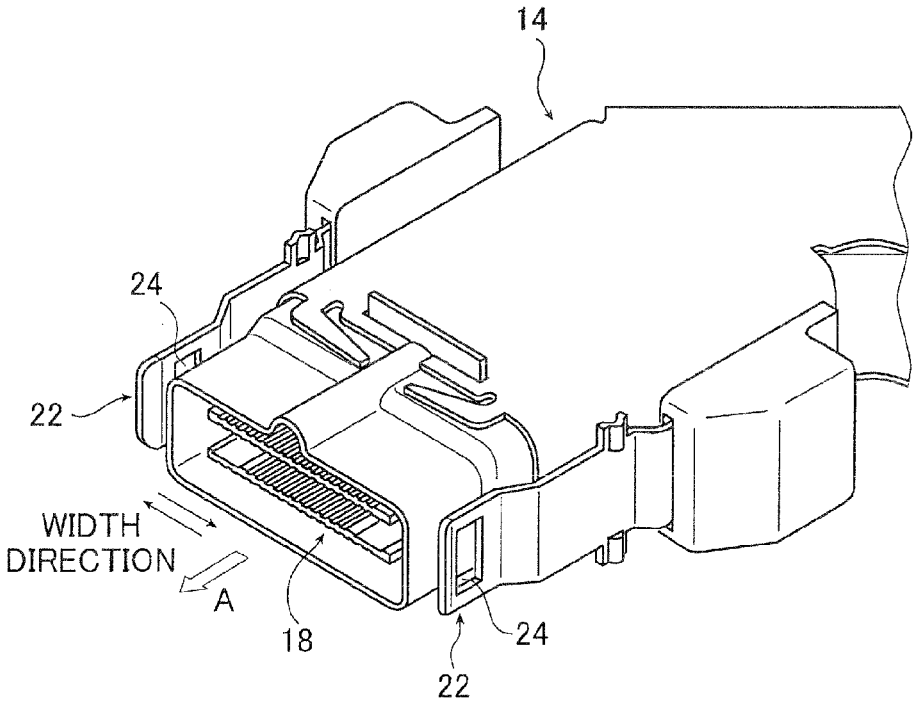
FIG. 1B is a schematic perspective view of a cable-side connector to be connected to the connector for on-board mounting in FIG. 1A.

In FIG. 1A, illustration of wiring and mounted components on the printed circuit board 10 is omitted. FIG. 1B is a perspective view of the cable-side connector 14 to be connected to the printed circuit board 10.

As illustrated in FIGS. 1A and 1B, the cable-side connector 14 is moved in the direction A so that a contact group 16 of the connector 12 and a contact group 18 of the connector 14, in each of which multiple contacts are arranged in the width direction, are electrically connected to each other, and locking engagement members 20 provided outside in the width direction on both sides of the contact group 16 are engaged with locked engagement members 22 of the cable-side connector 14, to thereby achieve locking. In this manner, the board-side connector 12 mounted on the printed circuit board 10 is connected to the cable-side connector 14.

The width direction as referred to above represents a direction orthogonal to the front direction and parallel to the plane of the printed circuit board 10.

The functions of the locking engagement members 20 and the locked engagement members 22 are described in more detail.

The locked engagement members 22 of the cable-side connector 14 in FIG. 1B are members made of a metal material, each having a flat, elongated shape protruding in the direction A, which are provided outside in the width direction on both sides of the contact group 18 in which multiple contacts are arranged in the width direction, and have openings 24 formed in their leading end portions. Further, spring components (not shown) are provided which restore the locked engagement members 22 to the original positions, that is, which impart an urging force in the inward direction to the locked engagement members 22, when the locked engagement members 22 are forced in a direction causing the increase in distance between the openings 24 on both sides (outward direction). Therefore, when the cable-side connector 14 is connected to the board-side connector 12, claws of locking portions 26 provided in the leading end portions of the locking engagement members 20 of the board-side connector 12 intrude into the openings 24 so as to stay therein, with the locked engagement members 22 being forced from the inside to the outside thereof. The inward urging force is imparted from the above-mentioned spring components (not shown) to the locked engagement members 22 forced outward, and the locking portions 26 are engaged and stopped with the openings 24. In this manner, the board-side connector 12 and the cable-side connector 14 are connected to each other. The locking engagement members 20 and the locked engagement members 22 as described above are made of a metal material.

Figure 2A:
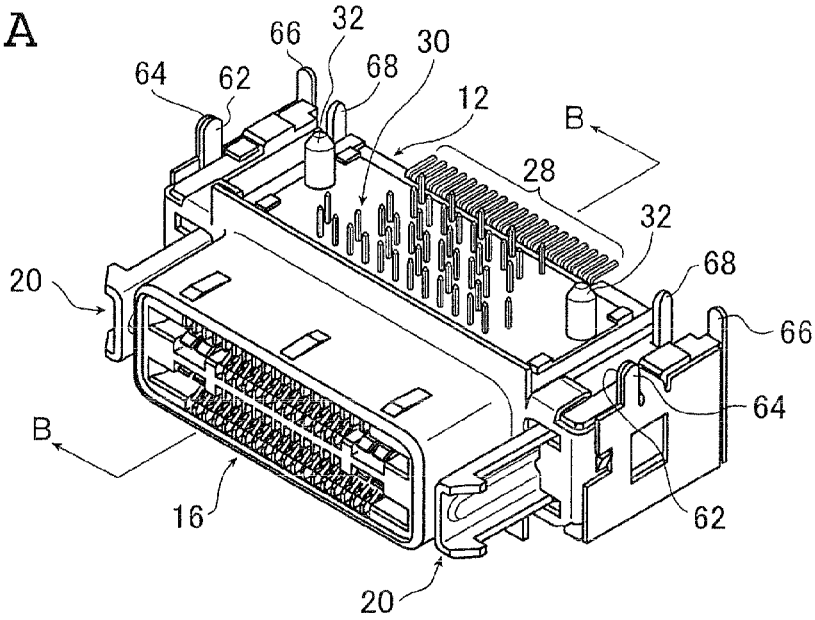
FIG. 2A is a schematic perspective view of the connector for on-board mounting illustrated in FIG. 1A, as seen from the side where located is the board on which the connector is mounted.
Figure 2B:
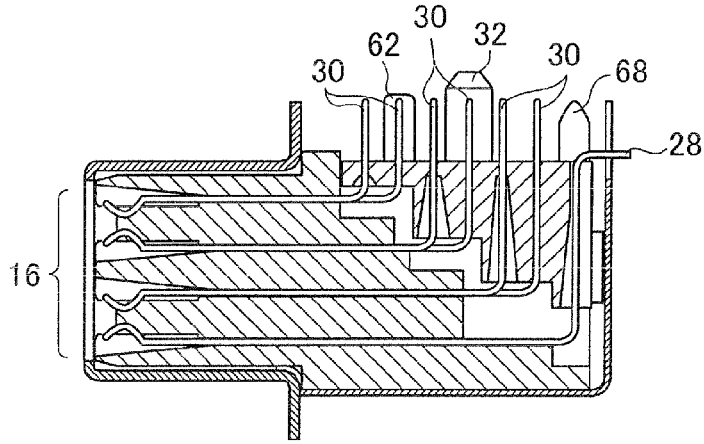
FIG. 2B is a sectional view taken along the arrow line B-B in FIG. 2A.

FIG. 2A is a schematic perspective view of the board-side connector 12, as seen from the side where located is the printed circuit board 10 on which the connector is mounted. FIG. 2B is a sectional view taken along the arrow line B-B in FIG. 2A.

Figure 3:
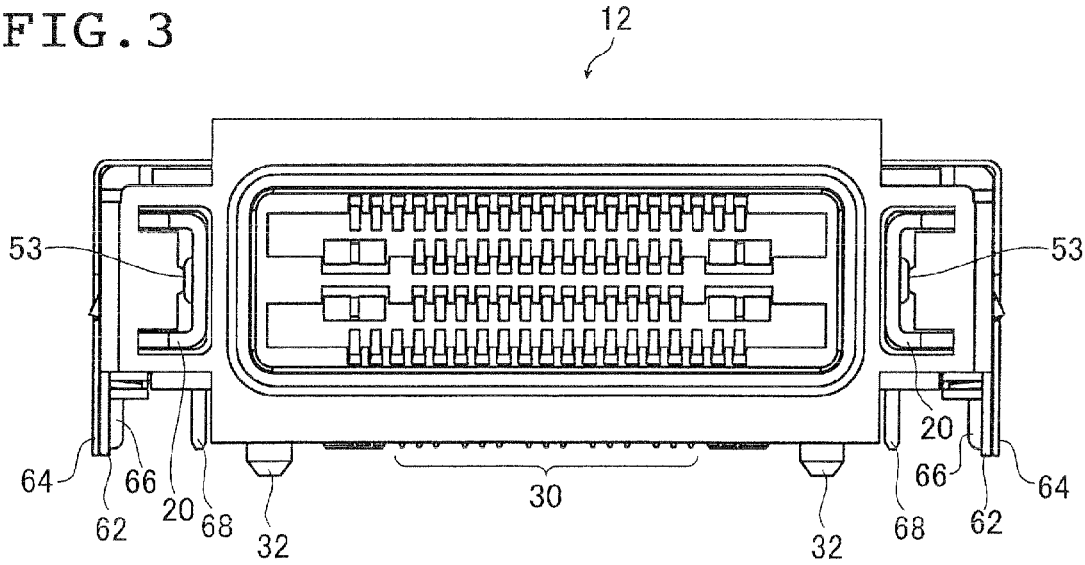
FIG. 3 is a front view of the connector for on-board mounting illustrated in FIG. 1A, which is obtained in the direction A in FIG. 1A.

The board-side connector 12 has a horizontal terminal group 28 and a perpendicular terminal group 30. Terminals of the horizontal terminal group 28, as extending along a front side 10*a* (refer to FIG. 1A) of the printed circuit board 10, are to be connected to the wiring on the front side 10*a* of the printed circuit board 10 on which the board-side connector 12 is disposed. Terminals of the perpendicular terminal group 30 are provided upright with respect to the bottom surface of the board-side connector 12 that faces the front side 10*a*, and are to be connected to the wiring on a back side 10*b* (refer to FIG. 1A) of the printed circuit board 10, or to the wiring provided in an intermediate layer of the printed circuit board 10. As illustrated in FIG. 2B, the terminals of the horizontal terminal group 28 and the perpendicular terminal group 30 are connected to the contacts of the contact group 16 of the board-side connector 12 in a one-to-one manner. Further, the board-side connector 12 is provided with protrusions 32 upright with respect to the bottom surface facing the front side 10*a* of the printed circuit board 10. The protrusions 32 are used for the alignment with the holes provided in predetermined positions on the printed circuit board 10. Still further, multiple solder posts 62, 64, 66 and 68 protruding toward the printed circuit board 10 are provided as board-connecting posts. The solder posts 62, 64, 66 and 68 are described later. FIG. 3 is a front view of the board-side connector 12, which is taken in the direction A in FIG. 1A.

Figure 4:
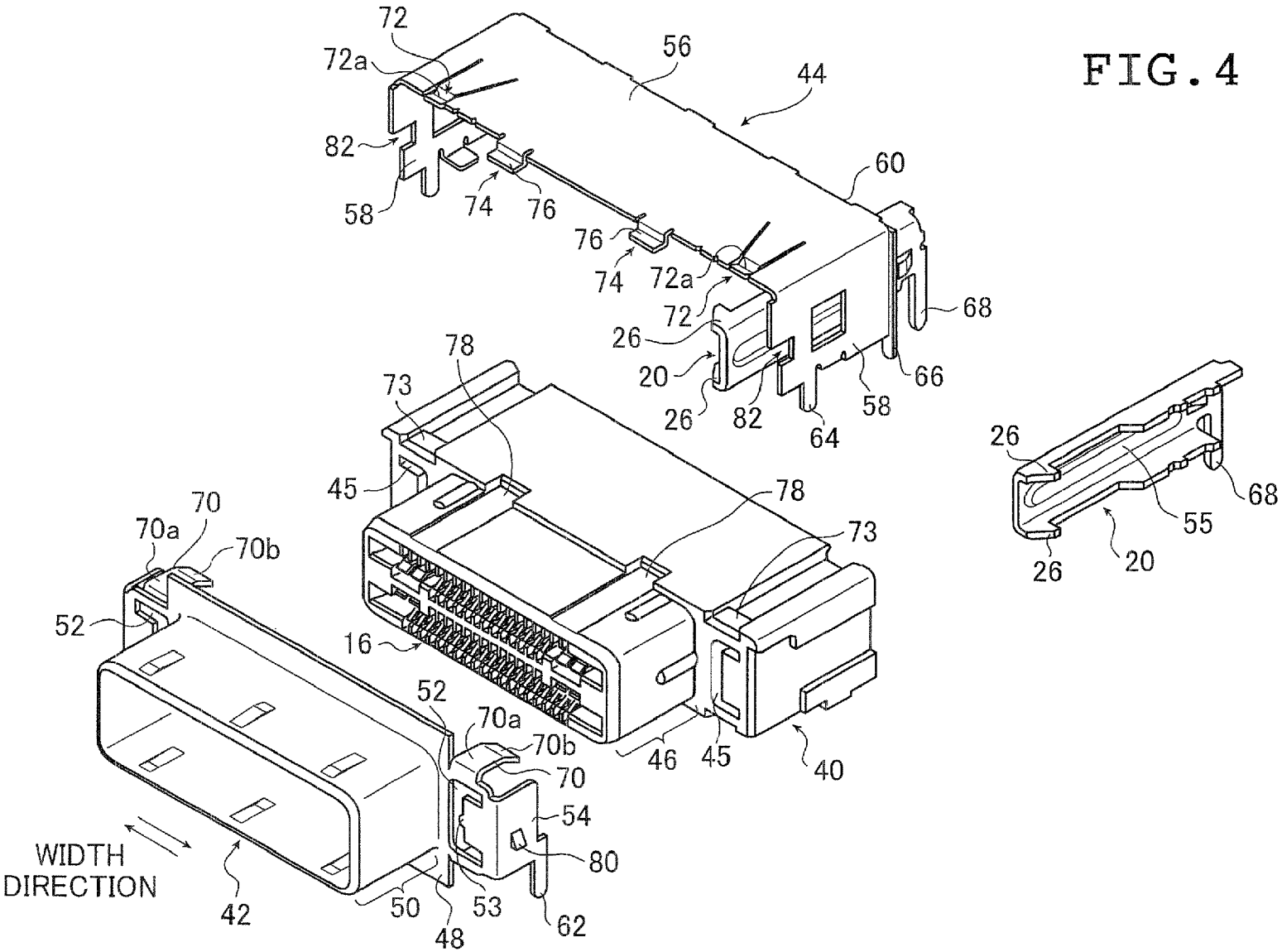
FIG. 4 is an exploded perspective view illustrating structure of the connector for on-board mounting illustrated in FIG. 1A.

FIG. 4 is an exploded perspective view illustrating structure of the board-side connector 12.

As illustrated in FIG. 4, the board-side connector 12 mainly has a pair of locking engagement members 20 described above, a housing body 40, a front outer shell member 42, and a rear outer shell member 44.

As illustrated in FIG. 2B, the housing body 40 is a member made of an insulative material such as a resin material, in which the contact group 16 comprising metal contacts extending to the front is incorporated. The housing body 40 is provided with grooves and holes (not shown) such that each contact of the contact group 16 is incorporated into a predetermined position. While being constituted by combining, after incorporating the contact group 16, two members into one member such that the contact group 16 is efficiently incorporated into the grooves and holes (not shown), the housing body 40 may be constituted as an originally single member.

As described above, the locking engagement members 20 are provided with the locking portions 26 to be engaged with the locked engagement members 22 provided on the cable-side connector 14 for the purpose of locking the connection between the board-side connector 12 and the cable-side connector 14, and, as extending to the front, are fixed to the housing body 40. The locking engagement members 20 are members made of a metal material.

Outside in the width direction, on both sides of the portion, in which the contact group 16 is provided, of the housing body 40, through-holes 45 for fixing the locking engagement members 20 are provided. The locking engagement members 20 are press-fitted from rear to front into the through-holes 45, whereby the locking engagement members 20 are fixed to the housing body 40.

The front outer shell member 42 is a member made of a metal material, covering the side wall of the front protruding portion 46 of the housing body 40, and being to be engaged with the cable-side connector 14, which member is manufactured through working of a thin metal plate. As illustrated in FIG. 1A, the front outer shell member 42 has a base portion 48 so arranged as to abut on the printed circuit board 10 along the board edge and having a surface directed to the front, and a leading end portion 50 cylindrically protruding from the base portion 48 to the front and covering the front protruding portion 46 (refer to FIG. 4) of the housing body 40. The cylindrical leading end portion 50 is engaged with the cable-side connector 14. In the surface of the base portion 48, which is directed to the front, openings 52 are provided in the positions corresponding to the locking engagement members 20 extending to the front. Further, rear bent portions 54 formed by bending the base portion 48 by 90° to the rear are provided on the outer side of the openings 52.

Protruding portions 53 are provided on the edges of the surface of the base portion 48, which define the openings 52. Meanwhile, ribs 55 protruding in a convex manner toward the protruding portions 53 are provided in the positions on the locking engagement members 20 which correspond to the portions 53. With this structure, the ribs 55 and the protruding portions 53 are reliably brought into contact with each other. As a result, the front outer shell member 42 and the locking engagement members 20 are reliably and electrically connected to each other.

The rear outer shell member 44 is a member made of a metal material, provided to the rear of the front outer shell member 42, and covering the side wall surfaces of the rear portion of the housing body 40 other than the bottom surface located on the printed circuit board 10, the rear outer shell member 44 being manufactured through working of a thin metal plate.

When the printed circuit board 10 side of the board-side connector 12 which is disposed on the printed circuit board 10 is defined as a lower side, and the side opposite to the lower side as an upper side, the rear outer shell member 44 has an upper surface portion 56 for covering the upper surface of the housing body 40, side surface portions 58, which are bent downward by 90° from the upper surface portion 56 so as to cover the side surfaces of the housing body 40 outside in the width direction, and a rear surface portion 60 for covering the rear surface of the rear portion of the housing body 40.

On the lower side of the rear bent portions 54 of the front outer shell member 42, the solder posts 62 protruding toward the printed circuit board 10 are provided as a part of the front outer shell member 42. Also on the lower side of the side surface portions 58 and rear surface portion 60 of the rear outer shell member 44, the solder posts 64 and 66 protruding toward the printed circuit board 10 are provided as a part of the rear outer shell member 44. Further, also on the lower side of the rear portions of the locking engagement members 20, the solder posts 68 protruding toward the printed circuit board 10 are provided as a part of the locking engagement members 20. The solder posts 62, 64, 66 and 68 extend through the through-holes (not shown) provided in the printed circuit board 10 so as to reach the back side 10*b* thereof. Then, the solder posts are soldered to the ground line which is provided on the back side 10*b*, thereby being fixedly connected to the printed circuit board 10. As described above, all of the locking engagement members 20, the front outer shell member 42, and the rear outer shell member 44 are individually connected to the ground. Therefore, even when static electricity is transmitted from the charged cable-side connector or operator, the static electricity can be discharged to the ground, making it possible to take countermeasures against ESD reliably. Still further, the solder posts 62, 64, 66 and 68 function so as to achieve a reliable fixing to the printed circuit board 10. As described above, the solder posts 62, 64, 66 and 68 function as board-connecting posts.

Further, in a state where the front outer shell member 42 is positioned with respect to the housing body 40 so that it may cover the front protruding portion 46 of the housing body 40, the rear outer shell member 44 is engaged with the front outer shell member 42 from the rear thereof as described later. In this manner, the front outer shell member 42 and the rear outer shell member 44 are fixed to the housing body 40. The rear outer shell member 44 and the front outer shell member 42 are electrically connected to each other by being engaged with each other. Therefore, when the front outer shell member 42 receives static electricity from the charged cable-side connector 14 or operator, the static electricity can be discharged from the front outer shell member 42 to the ground through an intermediation of the solder posts 64 and 66 of the rear outer shell member 44. As a matter of course, the static electricity can also be discharged to the ground not only from the solder posts 62 of the front outer shell member 42 but also the solder posts 68 of the locking engagement members 20 electrically connected to the member 42. As described above, even when the front outer shell member 42 receives static electricity, multiple paths are provided for discharging the static electricity to the ground. Therefore, even when electrical connection failure occurs in one path, the static electricity can be reliably discharged through an intermediation of another. With this structure, countermeasures against ESD can be stably and reliably realized.

Similarly, even when the rear outer shell member 44 receives static electricity, multiple paths are provided for discharging the static electricity to the ground. Therefore, even when electrical connection failure occurs in one path, the static electricity can be reliably discharged through an intermediation of another. With this structure, countermeasures against ESD can be stably and reliably realized.

Even when the locking engagement members 20 receive static electricity from the locked engagement members 22 of the charged cable-side connector 14, the static electricity can be discharged to the ground not only through an intermediation of the solder posts 68 of the locking engagement members 20 but also the solder posts 62 of the front outer shell member 42 through electrical connection between the locking engagement members 20 and the front outer shell member 42. In addition, the static electricity can be discharged to the ground through an intermediation of the solder posts 64 and 66 of the rear outer shell member 44 which is electrically connected to the front outer shell member 42. As described above, even when the locking engagement members 20 receive static electricity, multiple paths are provided for discharging the static electricity to the ground. Therefore, even when electrical connection failure occurs in one path, the static electricity can be reliably discharged through an intermediation of another. With this structure, countermeasures against ESD can be stably and reliably realized.

The rear outer shell member 44 is engaged with the front outer shell member 42 as described below, and fixed to the housing body 40.

Figure 5:
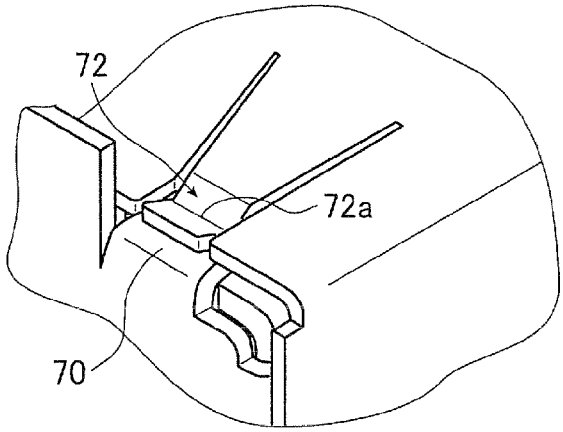
FIG. 5 is an explanatory diagram illustrating the engagement between a front outer shell member and a rear outer shell member of the connector for on-board mounting illustrated in FIG. 1A.

As illustrated in FIG. 4, the front outer shell member 42 has the portions protruding toward the rear outer shell member 44 as fixed pieces 70. The fixed pieces 70 comprise horizontal portions 70*a* extending to the rear, which are the upper edge portions of the base portion 48 of the front outer shell member 42 bent to the rear, and downward inclined portions 70*b* at the rear leading ends thereof. Meanwhile, the rear outer shell member 44 is provided with contact spring pieces 72 in the positions corresponding to the fixed pieces 70 in the width direction, the contact spring pieces 72 pressing the horizontal portions 70*a* of the fixed pieces 70 toward the housing body 40. The contact spring pieces 72 maintain the electrical connection between the front outer shell member 42 and the rear outer shell member 44. Specifically, as illustrated in FIG. 5, the contact spring pieces 72 are formed by cutting slits in the front edge portions of the upper surface portion 56 of the rear outer shell member 44 in a V shape, and are provided on the front side with bent portions 72*a* exhibiting a downward convex shape. The bent portions 72*a* press the horizontal portions 70*a*.

The downward inclined portions 70*b* of the fixed pieces 70 are engaged and stopped with engaging grooves 73 so provided on the housing body 40 as to extend to the front and the rear. At the lower edge (not shown) of the base portion 48 of the front outer shell member 42, fixed pieces (not shown) are provided in the positions corresponding to the fixed pieces 70 in the width direction. These fixed pieces are engaged and stopped with the engaging grooves (not shown) which are provided on the lower side of the housing body 40 similarly to the engaging grooves 73. With this structure, the front outer shell member 42 is positioned with respect to the housing body 40 in the width direction.

Figure 6A:
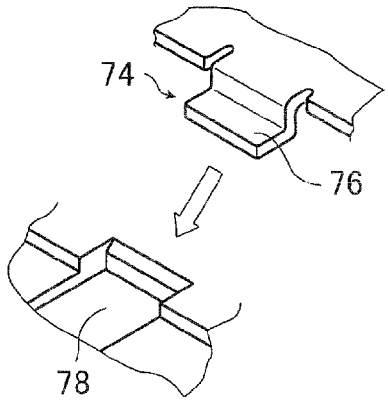
FIGS. 6A and 6B are each an explanatory diagram other than FIG. 5, which illustrates the engagement between the front outer shell member and the rear outer shell member of the connector for on-board mounting illustrated in FIG. 1A.

Further, as illustrated in FIG. 4, a pair of bent elongations 74 are provided at the front edge of the rear outer shell member 44 that abuts on the front outer shell member 42, the elongations being bent in a stepped configuration. The front leading ends of the bent elongations 74 form protruding pieces 76 protruding to the front. In the positions on the housing body 40 corresponding to the protruding pieces 76 in the width direction, protruding piece insertion grooves 78 extending to the front and the rear are provided. As illustrated in FIG. 6A, the protruding pieces 76, as being positioned in the width direction, are inserted into the protruding piece insertion grooves 78.

Figure 6B:
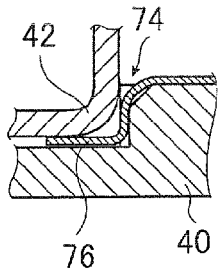

As illustrated in FIG. 6B, when the rear outer shell member 44 is engaged with the front outer shell member 42, the protruding pieces 76 engaged and stopped with the protruding piece insertion grooves 78 are sandwiched in a press-contact manner between the front outer shell member 42 and the housing body 40.

Meanwhile, the front outer shell member 42 and the rear outer shell member 44 are provided with an engaging/stopping mechanism for fixing the front outer shell member 42 and the rear outer shell member 44 together such that their relative displacement is prevented upon engagement. Specifically, when the rear outer shell member 44 is engaged with the front outer shell member 42, the surfaces of the rear bent portions 54 of the front outer shell member 42 and the surfaces of the side surface portions 58 of the rear outer shell member 44 are brought into contact with each other in an overlapping manner. The side surface portions 58 in contact with the rear bent portions 54 are positioned with respect to the portions 54 outside in the width direction.

Figure 7:
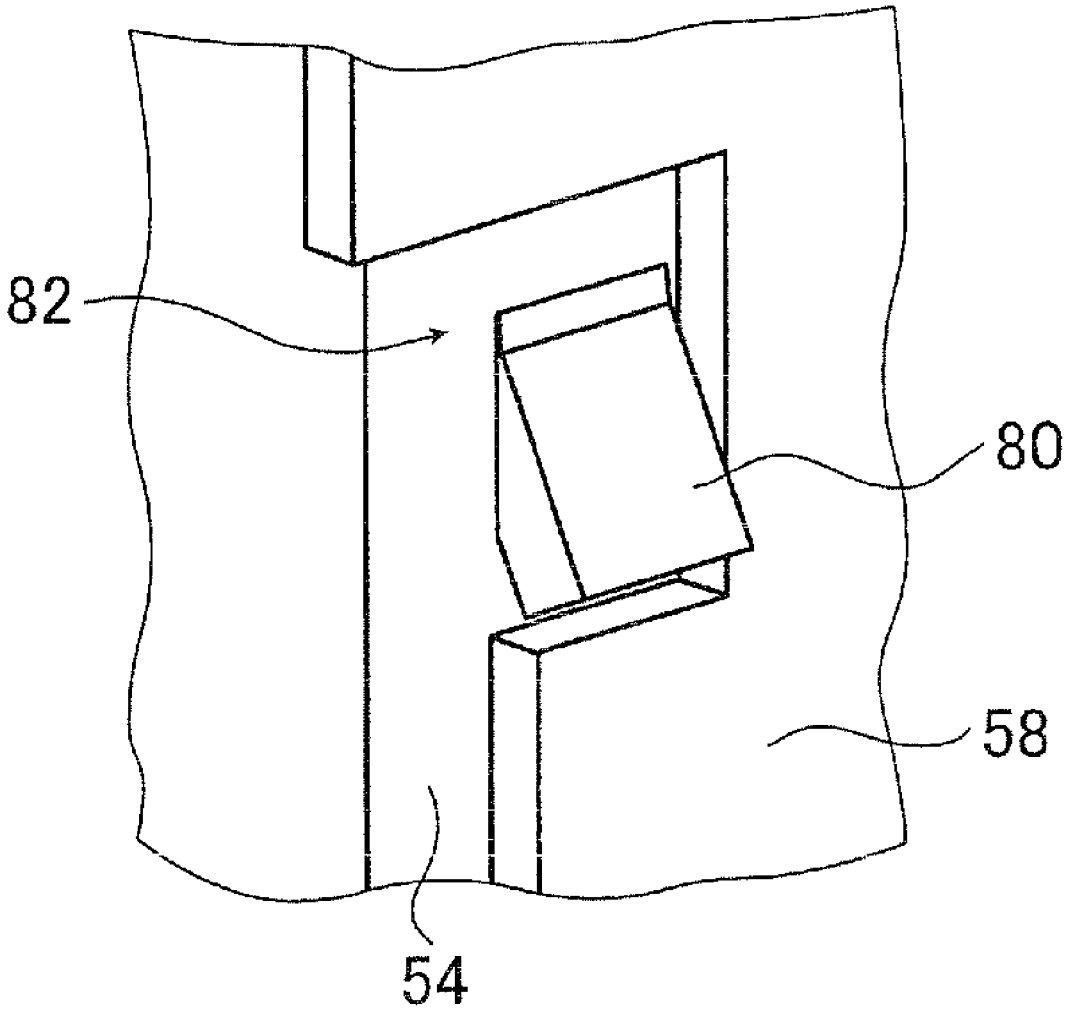
FIG. 7 is an explanatory diagram other than any of FIGS. 5, 6A and 6B, which illustrates the engagement between the front outer shell member and the rear outer shell member of the connector for on-board mounting illustrated in FIG. 1A.

Protruding portions 80 protruding in a direction outward from the surface are provided on the outer side surfaces of the rear bent portions 54, and notched grooves 82 are provided in the side surface portions 58 of the rear outer shell member 44 through notching of the front edge portions of the side surface portions 58 in the positions corresponding to the protruding portions 80 in the height direction (vertical direction). When the rear outer shell member 44 is moved from the rear to the front so as to engage it with the front outer shell member 42, as illustrated in FIG. 7, the protruding portions 80 are engaged and stopped with the notched grooves 82. In this manner, the rear outer shell member 44 and the front outer shell member 42 are fixed to the housing body 40. As illustrated in FIG. 7, the peaks of protruding height of the protruding portions 80 are located on the lower side, and steps having steep inclination are formed below the peaks. Therefore, the rear outer shell member 44 is prevented from being displaced upward.

The board-side connector 12 as described above is assembled as follows.

First, the fixed pieces 70 of the front outer shell member 42 are engaged and stopped with the engaging grooves 73 of the housing body 40 so as to perform positioning in the width direction. In this state, the cylindrical leading end portion 50 of the front outer shell member 42 is arranged from the front so that it may cover the front protruding portion 46 of the housing body 40.

Next, the rear outer shell member 44 is arranged from the upper rear so that the protruding pieces 76 of the rear outer shell member 44 may be inserted between the front outer shell member 42 and the protruding piece insertion grooves 78 of the housing body 40. The contact spring pieces 72 of the rear outer shell member 44 press the horizontal portions 70*a* of the fixed pieces 70 of the front outer shell member 42 from above so as to suppress the front outer shell member 42 from being raised to the upper side.

Next, with the protruding pieces 76 being in a sandwiched state, the rear outer shell member 44 is pressed downward at the rear portion thereof and slid to the front, whereby the protruding portions 80 of the front outer shell member 42 are engaged and stopped with the notched grooves 82 of the rear outer shell member 44. In this manner, the rear outer shell member 44 is engaged with respect to the front outer shell member 42. The rear surface portion 60 of the rear outer shell member 44 is so provided as to cover the rear surface of the housing body 40. The rear surface portion 60 thus abuts on the rear surface portion of the housing body 40, so that the front outer shell member 42 engaged with the rear outer shell member 44 is restrained from moving to the front. With this structure, the front outer shell member 42 and the rear outer shell member 44 are fixed to the housing body 40.

As described above, the rear outer shell member 44 is engaged with the front outer shell member 42 fixed to the housing body 40 while covering the side wall of the front protruding portion 46 of the housing body 40, with the protruding pieces 76 of the rear outer shell member 44 being sandwiched between the front outer shell member 42 and the housing body 40. At the same time, the contact spring pieces 72 of the rear outer shell member 44 press the horizontal portions 70*a* of the front outer shell member 42. Further, the notched grooves 82 of the rear outer shell member 44 engage and stop the protruding portions 80 of the front outer shell member 42, whereby the rear outer shell member 44 is engaged with the front outer shell member 42. In this manner, the front outer shell member 42 and the rear outer shell member 44 are stably fixed to the housing body 40.

In addition, the front outer shell member 42 and the rear outer shell member 44 are held in contact with each other at the multiple points as described above, and in particular, the protruding pieces 76 are held in contact with the front outer shell member 42 in a press-contact manner. Therefore, electrical connection therebetween is also stably ensured.

In the above-mentioned embodiment, the front outer shell member 42 is provided with the fixed pieces 70 and the protruding portions 80, and the rear outer shell member 44 is provided with the protruding pieces 76, the contact spring pieces 72, and the notched grooves 82. However, the present invention is not limited thereto. It is also possible to provide the fixed pieces 70 and the protruding portions 80 on any one of the front outer shell member 42 and the rear outer shell member 44, and to provide the protruding pieces 76, the contact spring pieces 72, and the notched grooves 82 on the other outer shell member.

Further, the board-connecting posts of the present invention are not limited to the solder posts passing through the printed circuit board 10 and connected to the ground line on the back side 10*b*. Surface-mount posts connected to the ground line on the front side 10*a* may be used.

While detailed description of the connector for on-board mounting according to the present invention has been made as above, the present invention is not limited to the above-mentioned embodiment. As a matter of course, various improvements and modifications may be made thereto without departing from the spirit of the present invention.

What is claimed is:

1. A connector for on-board mounting, which is mounted to a board and is connected to a cable-side connector, comprising:

a housing body made of an insulative material having multiple contacts which extend to a front and are incorporated therein, premising that a side on which said connector for on-board mounting is connected to said cable-side connector is the front;

metal locking engagement members, each comprising a locking portion to be engaged with a locked engagement member provided to said cable-side connector for a purpose of locking a connection between said connector for on-board mounting and said cable-side connector, extending to the front, and being fixed to said housing body; and a metal outer shell member fixed to said housing body so as to cover a side wall of a front portion of said housing body and provided with opening portions through each of which each of said locking engagement members extending to the front passes, wherein:

each of said opening portions of said outer shell member is provided such that an edge of said outer shell member which face to each of said opening portions, and each of said locking engagement members are brought into contact with each other; and both each of said locking engagement members, and said outer shell member are provided with board-connecting posts on rear portions thereof to be disposed on said board.

2. The connector for on-board mounting according to claim 1, wherein:

said outer shell member comprises a front outer shell member which has a cylindrical portion for covering the side wall of said front portion, in which said multiple contacts extend to the front, of the housing body so as to be engaged with said cable-side connector, and a rear outer shell member provided to a rear of said front outer shell member, for covering a side wall of a rear portion of said housing body; and both said front outer shell member and said rear outer shell member are provided with said board-connecting posts.

3. The connector for on-board mounting according to claim 2, wherein:

said front outer shell member is arranged, while covering the side wall of said housing body, from the front so as to be positioned with respect to said housing body; and said rear outer shell member is engaged with said front outer shell member from a rear of said housing body so that said front outer shell member and said rear outer shell member are fixed to said housing body.

4. The connector for on-board mounting according to claim 2, wherein:

one of said front outer shell member and said rear outer shell member is provided with fixed pieces partially protruding toward another of said front outer shell member and said rear outer shell member, said another of said front outer shell member and said rear outer shell member being provided with contact spring pieces at positions corresponding to said fixed pieces, said contact spring pieces pressing said fixed pieces toward said housing body for a purpose of maintaining an electrical connection between said front outer shell member and said rear outer shell member;

said rear outer shell member is provided with protruding pieces which partially protrude toward said front outer shell member so as to sandwiched between said front outer shell member and said housing body in a press-contact manner; and said front outer shell member and said rear outer shell member are provided with an engaging/stopping mechanism in which said protruding pieces are arranged while being sandwiched between said front outer shell member and said housing body for a purpose of fixing said front outer shell member and said rear outer shell member so that a relative position therebetween is prevented from being displaced.

5. The connector for on-board mounting according to claim 3, wherein:

one of said front outer shell member and said rear outer shell member is provided with fixed pieces partially protruding toward another of said front outer shell member and said rear outer shell member, said another of said front outer shell member and said rear outer shell member being provided with contact spring pieces at positions corresponding to said fixed pieces, said contact spring pieces pressing said fixed pieces toward said housing body for a purpose of maintaining an electrical connection between said front outer shell member and said rear outer shell member;

said rear outer shell member is provided with protruding nieces which partially protrude toward said front outer shell member so as to sandwiched between said front outer shell member and said housing body in a press-contact manner; and said front outer shell member and said rear outer shell member are provided with an engaging/stopping mechanism in which said protruding pieces are arranged while being sandwiched between said front outer shell member and said housing body for a purpose of fixing said front outer shell member and said rear outer shell member so that a relative position therebetween is prevented from being displaced.

6. The connector for on-board mounting according to claim 4, wherein:

said front outer shell member and said rear outer shell member have contact surfaces which are overlapped with each other when said front outer shell member and said rear outer shell member are engaged with each other;

said engaging/stopping mechanism comprises:

notched grooves, each being provided in one of said contact surfaces, and protruding portions, each being provided on another of said contact surfaces so as to protrude outward from said another of said contact surfaces correspondingly to each of said notched grooves; and each of said protruding portions is engaged and stopped to each of said notched grooves so that said rear outer shell member is engaged with respect to said front outer shell member.

7. The connector for on-board mounting according to claim 5, wherein:

said front outer shell member and said rear outer shell member have contact surfaces which are overlapped with each other when said front outer shell member and said rear outer shell member are engaged with each other;

said engaging/stopping mechanism comprises:

notched grooves, each being provided in one of said contact surfaces, and protruding portions, each being provided on another of said contact surfaces so as to protrude outward from said another of said contact surfaces correspondingly to each of said notched grooves; and each of said protruding portions is engaged and stopped to each of said notched grooves so that said rear outer shell member is engaged with respect to said front outer shell member.

* * * * *